US005687969A

United States Patent [19]

Logan

[11] Patent Number: 5,687,969

[45] Date of Patent: Nov. 18, 1997

[54] BATTLE BOARD GAME

[76] Inventor: Dean X. Logan, 345 Adelaide Avenue W. Apt. #3, Oshawa, Ontario, Canada, LIJ2R7

[21] Appl. No.: 650,839

[22] Filed: May 20, 1996

[51] Int. Cl.[6] ..... A63F 3/00

[52] U.S. Cl. ..... 273/255; 273/253

[58] Field of Search ..... 273/253, 255, 273/275, 284, 285

[56] References Cited

U.S. PATENT DOCUMENTS

| | | | |
|---|---|---|---|
| 4,480,837 | 11/1984 | Poirier | 273/255 |
| 4,813,679 | 3/1989 | Hoffman | 273/284 |
| 4,828,268 | 5/1989 | Somerville | 273/284 |
| 5,026,069 | 6/1991 | Leask | 273/255 |

FOREIGN PATENT DOCUMENTS

| | | | |
|---|---|---|---|
| 2223178 | 4/1990 | United Kingdom | 273/253 |

*Primary Examiner*—William M. Pierce

[57] ABSTRACT

A new and improved battle board game for a plurality of players. The battle board game includes a plurality of sector cards with solar system indicia representing two imaginary planes imprinted thereon. Also included are a plurality of solar system cards corresponding with the solar system indicia of the sector cards for dictating a player's home solar system. A plurality of fighting tokens are included to move upon the sector cards. Also included are a plurality of dimensional path cards for allowing the fighting tokens to move between solar system indicia representing two different imaginary planes. A plurality of resource center cards are included with indicia corresponding to that of the sector cards for positioning resource center tokens on the sector card. Such resource center tokens allow a player to accumulate building material tokens which may be exchanged for additional fighting tokens.

3 Claims, 3 Drawing Sheets

BATTLE BOARD GAME

BACKGROUND OF THE INVENTION

1. Field of the Invention

The present invention relates to a battle board game and more particularly pertains to capturing another player's command ship token and home solar system indicia with a battle board game.

2. Description of the Prior Art

The use of board games is known in the prior art. More specifically, board games heretofore devised and utilized for the purpose of achieving an objective are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,026,069 to Leask discloses a method of playing a battle strategy game.

U.S. Pat. No. 5,118,115 to Codinha discloses an economic and military conflict board game.

U.S. Pat. No. 4,982,965 to Dozorsky discloses a strategic military type board game.

U.S. Pat. No. 5,033,753 to Yuen et al. discloses a method of playing a strategic board game.

U.S. Pat. No. 5,004,245 to Schumacher et al. discloses a method and apparatus for playing a game.

U.S. Pat. No. 3,989,254 to Cooper discloses a battle board game apparatus.

While these devices fulfill their respective, particular objective and requirements, the aforementioned patents do not describe a battle board game for capturing another player's command ship token and home solar system indicia.

In this respect, the battle board game according to the present invention substantially departs from the conventional concepts and designs of the prior art, and in doing so provides an apparatus primarily developed for the purpose of capturing another player's command ship token and home solar system indicia.

Therefore, it can be appreciated that there exists a continuing need for new and improved battle board game which can be used for capturing another player's command ship token and home solar system indicia. In this regard, the present invention substantially fulfills this need.

SUMMARY OF THE INVENTION

In the view of the foregoing disadvantages inherent in the known types of board games now present in the prior art, the present invention provides an improved battle board game. As such, the general purpose of the present invention, which will be described subsequently in greater detail, is to provide a new and improved battle board game and method which has all the advantages of the prior art and none of the disadvantages.

To attain this, the present invention essentially comprises a plurality of sector cards. The sector cards have sector indicia, location markers, and solar system indicia selectively disposed thereon. The solar system comprises two different colors representing two different imaginary planes. Lines are imprinted on the sector cards for connecting the solar system indicia and location markers thus providing paths. The sector cards serve to construct the board game in any shape desired. The game also contains a plurality of solar system cards for selecting each player's home solar system indicia at the beginning of the game. Each of the solar system cards correspond with the sector indicia and solar system indicia selectively disposed on the sector cards. The game contains a plurality of attack cruiser tokens with two peg holes, battle cruiser tokens and command ship tokens both with four peg holes, and heavy cruiser tokens with three peg holes formed therein. The game also contains a plurality of dimensional path cards. Each of the dimensional path cards has sector indicia, solar system indicia and location markers disposed thereon corresponding with the like on the sector cards. Such dimensional path cards allow movement between solar systems representing the two different imaginary planes. A plurality of resource center cards are included with indicia corresponding to that of the sector cards for positioning resource center tokens at the beginning of the game. Such resource center tokens allow a player to accumulate building material tokens which may be exchanged for additional battle cruiser tokens, attack cruiser tokens, heavy cruiser tokens, and command ship tokens. The game contains a plurality of red pegs for removably inserting within the peg holes formed in the battle cruiser tokens, the attack cruiser tokens, the heavy cruiser tokens, and command ship cruiser tokens. The game further contains a counter with a white peg. The counter has four peg holes therein. The peg holes serve as a round indicator with the peg occupying one of the four peg holes to indicate the round. The game also includes a playing die for facilitating operation of the game.

Even still another object of the present invention is to provide a new and improved battle board game for capturing another player's command ship token and home solar system indicia.

Lastly, it is an object of the present invention to provide a new and improved battle board game for a plurality of players. The battle board game includes a plurality of sector cards with solar system indicia representing two imaginary planes imprinted thereon. Also included are a plurality of solar system cards corresponding with the solar system indicia of the sector cards for dictating a player's home solar system. A plurality of fighting tokens are included to move upon the sector cards. Also included are a plurality of dimensional path cards for allowing the fighting tokens to move between solar system indicia representing two different imaginary planes. A plurality of resource center cards are included with indicia corresponding to that of the sector cards for positioning resource center tokens on the sector card. Such resource center tokens allow a player to accumulate building material tokens which may be exchanged for additional fighting tokens.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
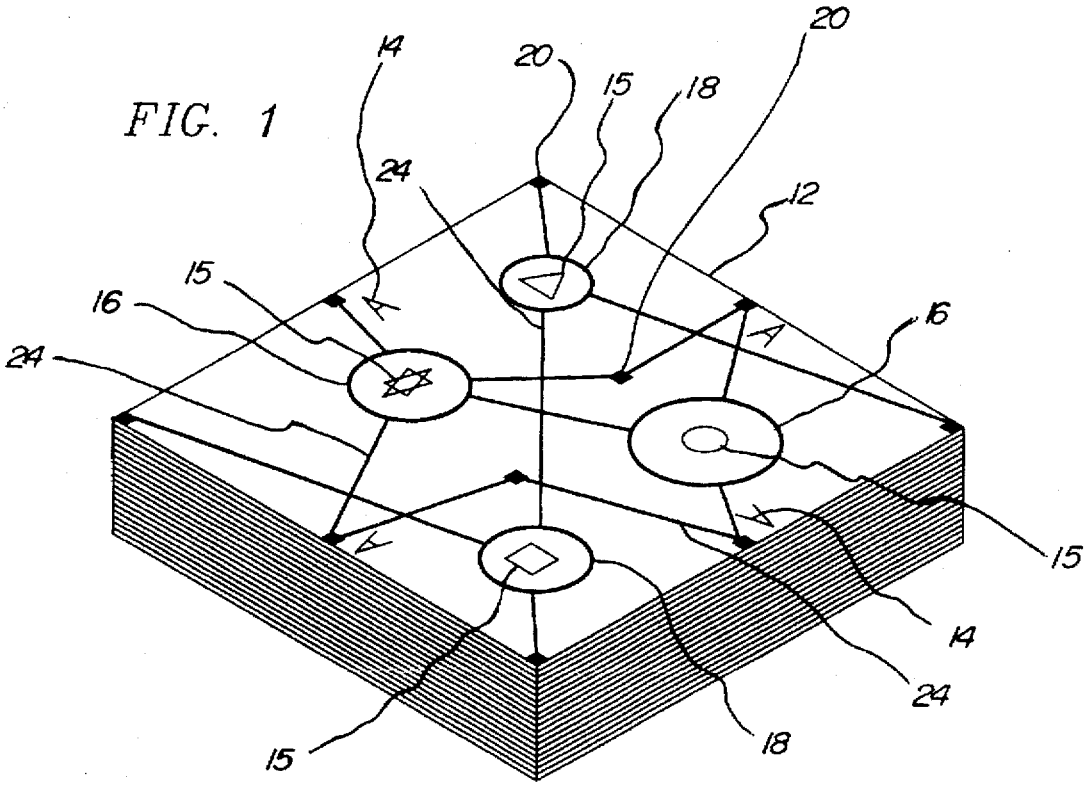
FIG. 1 is a perspective view of the sector cards of the present invention.
Figure 2:
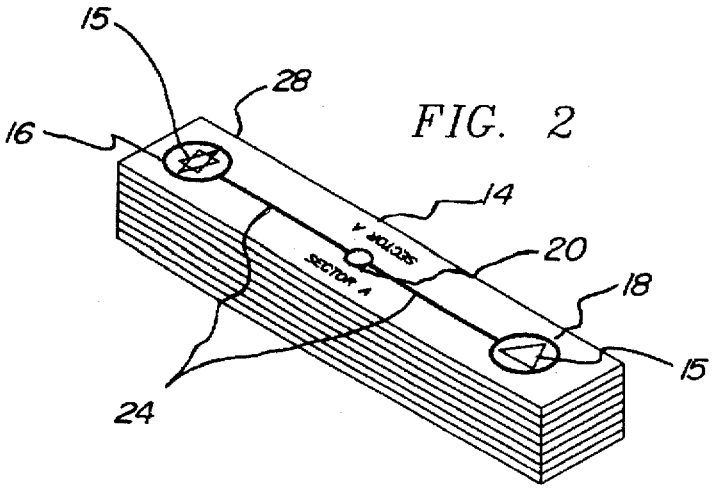
FIG. 2 is a perspective view of the dimensional path cards of the present invention.
Figure 3:
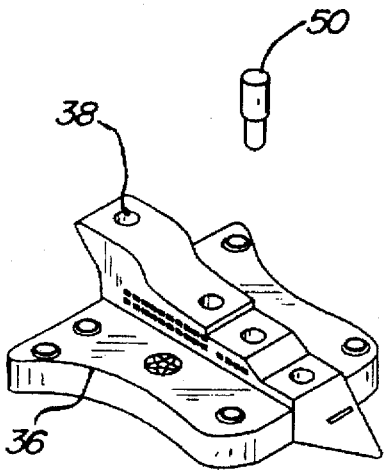
FIG. 3 is a perspective view of the battle cruiser tokens of the present invention.
Figure 4:
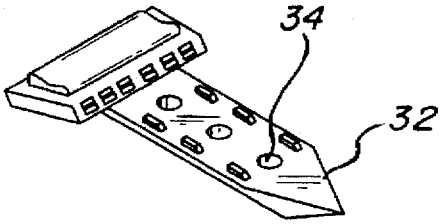
FIG. 4 is a perspective view of the heavy cruiser tokens of the present invention.
Figure 5:
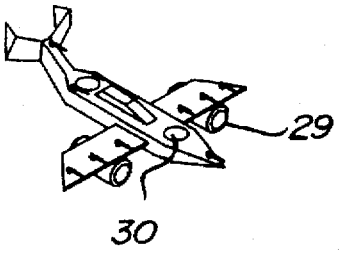
FIG. 5 is a perspective view of the attack cruiser tokens of the present invention.
Figure 7:
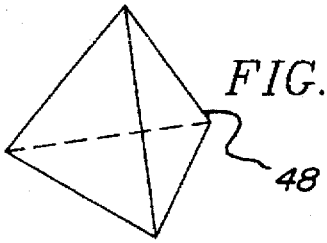
FIG. 7 is a perspective view of the building material tokens of the present invention.
Figure 6:
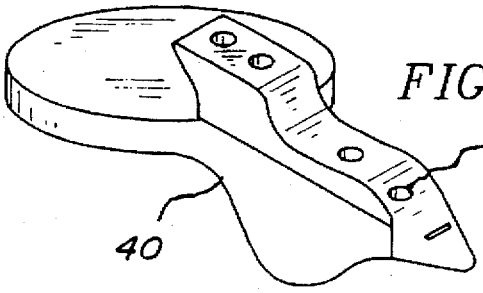
FIG. 6 is a perspective view of the command ship tokens of the present invention.
Figure 8:
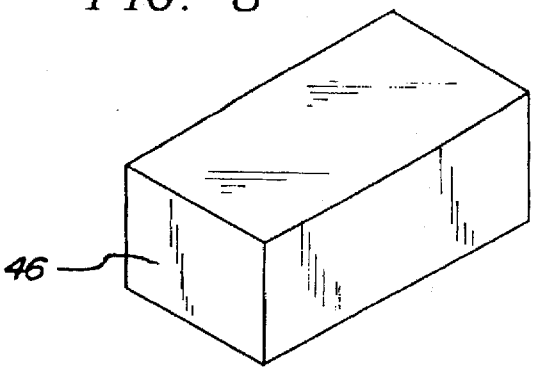
FIG. 8 is a perspective view of the resource center tokens of the present invention.
Figure 9:
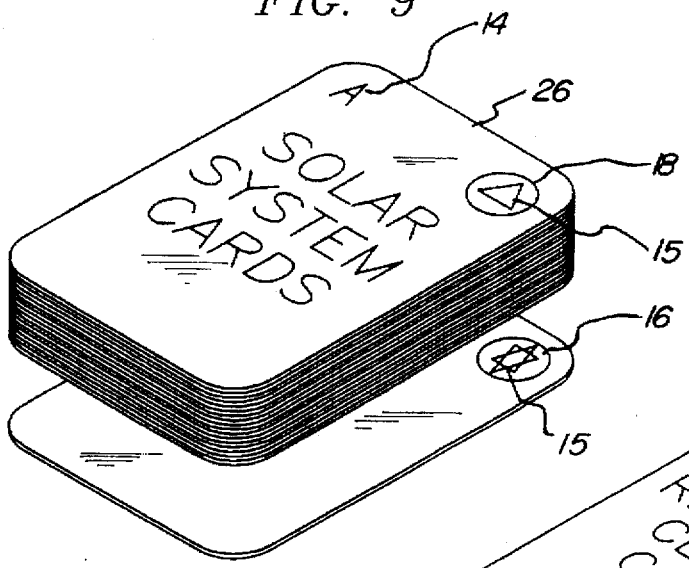
FIG. 9 is a perspective view of the solar system cards of the present invention.
Figure 10:
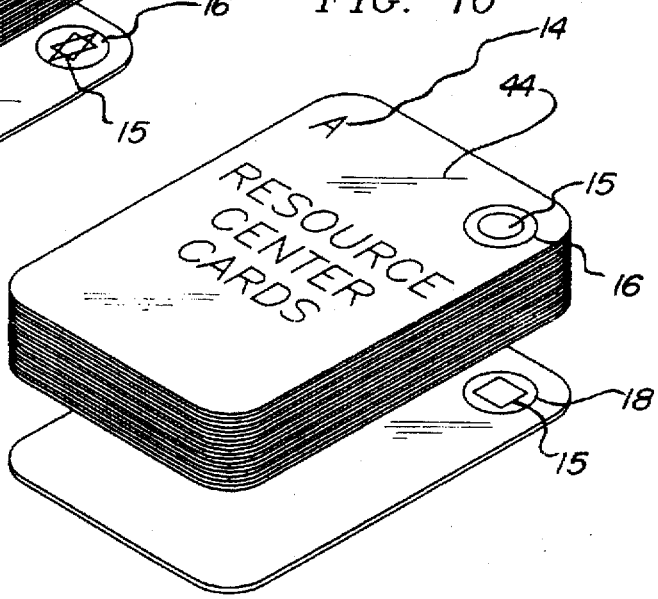
FIG. 10 is a perspective view of the resource center cards of the present invention.
Figure 11:
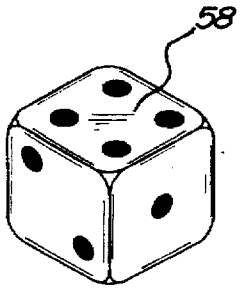
FIG. 11 is a perspective view of the playing die of the present invention.
Figure 12:
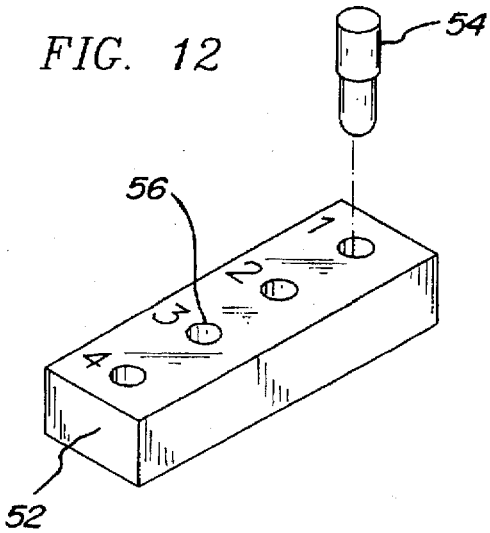
FIG. 12 is a perspective view of the round counter of the present invention.

With reference now to the drawings, and in particular to FIG. 1 thereof, a new and improved battle board game embodying the principles and concepts of the present invention and generally designated by the reference numeral 10 will be described.

The present invention, the new and improved battle board game, is comprised of a plurality of components. Such components in their broadest context include sector cards, solar system cards, dimensional path cards, ship and cruiser tokens, resource center cards and tokens, and a counter with a peg. Such components are individually configured and correlated with respect to each other so as to attain the desired objective.

More specifically, it will be noted that the system 10 of the present invention includes eighteen sector cards 12 with sector indicia disposed thereon 14. The sector cards are adapted to be constructed in any shape desired. The sector cards further have solar system indicia 15 with a first color 16 indicative of a first plane solar system and a second color 18 indicative of a second plane solar system selectively disposed thereon. A total of four solar system indicia are disposed on each sector card. Location markers 20 are also disposed on the sector cards. A plurality of connecting lines 24 are selectively disposed between the solar system indicia and location markers defining a plurality of paths therebetween.

Further included is a plurality of solar system cards 26. Each of the solar system cards has sector indicia 14 and solar system indicia 15 with a first color 16 indicative of a first plane solar system and a second color 18 indicative of a second plane solar system selectively disposed thereon for corresponding to a limited number of sector cards. The solar system cards are included for the purpose of picking each player's home solar system indicia at the beginning of the game as will be later described.

Nine dimensional path cards 28 each have sector indicia 14 and solar system indicia 15 with a first color 16 indicative of a first plane solar system and a second color 18 indicative of a second plane solar system corresponding to the sector cards 12. The dimensional path cards further have a location marker 20 disposed between the first plane solar system indicia 16 and second plane solar system indicia 18 with a connecting line 24 therebetween defining a path. The dimensional path cards serve to allow movement between a solar system indicia 15 with a first color 16 and solar system indicia 15 with a second color 18. Movement between the first and second planes which are signified by the different colors can only be done on the sector cards 12 with a corresponding dimensional path card. The token must progress along the dimensional path card as travelling along a path.

Also included is a plurality of attack cruiser tokens 29 having two peg holes 30 therein, a plurality of heavy cruiser tokens 32 having three peg holes 34 therein, a plurality of battle cruiser tokens 36 having four peg holes 38 therein, and a plurality of command ship tokens 40 having four peg holes 42 therein. The attack cruiser tokens, heavy cruiser tokens, battle cruiser tokens, and command ship tokens are all adapted to move along the paths.

A plurality of resource center cards 44 have sector indicia 14 and solar system indicia 15 with a first color 16 indicative of a first plane solar system and a second color 18 indicative of a second plane solar system selectively disposed thereon corresponding with the same limited number of sector cards as the solar system cards. Seven resource center tokens 46 consist of small grey blocks positionable on the solar system indicia. Placement of a resource center token is dictated by corresponding the sector indicia 14 and the solar system indicia 15 disposed on the resource center cards 44 with the like on the sector cards.

Sixty building material tokens 48 are included to allow exchanging for the battle cruiser tokens, attack cruiser tokens, heavy cruiser tokens, and command ship tokens. Four building material tokens are required to exchange for one battle cruiser token. Two building material tokens are required to exchange for one attack cruiser token. Three building material tokens are required to exchange for one heavy cruiser token. Five building material tokens are required to exchange for one command ship token. The building material tokens comprise of ten different colors.

A plurality of red pegs 50 are insertable within the peg holes of the battle cruiser tokens, attack cruiser tokens, heavy cruiser tokens, and command ship tokens. A counter 52 with a white peg 54 has four peg holes 56 therein. The peg holes serve as a round indicator with the peg occupying one of the four peg holes to indicate the round.

A playing die 58 is included for facilitating operation and use of the battle board game.

INSTRUCTIONS

SETTING UP THE BOARD:

1. Each player must select 3 sector cards so that the number of sector cards that correspond with the solar system cards equal the number of players plus one. The sector cards are required to construct the board.

2. The sector cards 12 must then be assembled. The assembly may take any design as long as the location markers 20 located along the periphery thereof are adjacent to each other.

3. Separate the corresponding dimensional path cards with sector indicia 14 represented on the chosen sector cards 12.

CHOOSING THE HOME SOLAR SYSTEM:

1. Shuffle the solar system cards 26. After shuffling, each player must roll the die. The player that rolls the highest number chooses a solar system card first. If the card does not correspond with a solar system on the board, the player chooses another until a match is chosen. The next player must then repeat the process. The card picked determines each player's home solar system. Each player keeps their home solar system card for referencing throughout the game. Only one home solar system indicia on a sector card is permitted for each player.

DEPLOYING THE TOKENS:

Each player receives 4 attack cruiser tokens, 2 heavy cruiser tokens, and 1 command ship token. The tokens are deployed on the solar system indicia 15 of the sector cards 12 which contains the home solar system.

LOCATING RESOURCE CENTERS:

Shuffle the resource center cards and choose one card at a time. The resource center cards indicate where to place the resource center tokens. If the indicia on the card matches the sector indicia on a sector card included in the board, a resource center token must be positioned at that location. If not, the player must choose another card. If rule 1 of "SETTING UP THE BOARD" is followed, the number of resource center tokens placed on the board will equal the number of players plus 1.

PLAYING RULES:

The player that rolled highest before choosing a home solar system plays first. Throughout the game, alliance may be made which constitutes a mutual agreement between two players not to fire upon each other.

During each player's turn, the player chooses what kind of action they would like to make. An action is defined as one of the following:

1) move 2) fire 3) repair

Each player may make as many actions as ships in their possession or a minimum of one action. However, one token can use more than one action such as a combination of a move and fire except when repairing. A token cannot make the same action twice, within a player's turn, unless executing a repertoire which constitutes engaging with tokens of two opposing players.

Repertoires can be applied at any point in the game and must be announced at the beginning of a player's turn. Prior to the player's turn, if being fired upon by 2 separate enemies on the same plane, a player has the option of an extra action. The extra action is invalid when any of the following conditions are met at the start of the player's turn.

1) one or both enemies declare a cease fire 2) one enemy has been defeated 3) no enemy tokens are within four location markers of the victim's token

MOVING:

All tokens, except the attack cruiser tokens, may travel a maximum of 2 locations which constitute either a location marker or solar system indicia. The attack cruiser tokens are the only tokens that may move a maximum of 3 locations per player's turn. The moves of an attack cruiser token can be split up within a player's turn using the same token, but no more than 3 locations. (ie. moving 1 location, firing and then moving 2 locations or moving 2 locations, firing, and then moving 1 location both constitute 3 actions for an attack cruiser token)

When 2 Attack Cruisers travel together by starting and ending together it is considered 1 action. A repertoire of a move is an option which allows a token to move twice, which is a use of all the player's actions. A repertoire of a move can be used when 2 attack cruisers travel together.

If a player has one or more tokens travelling together and attempts to pass another player's token(s), the travelling token(s) must stop for one round at the specific location of the other player's token(s).

To travel from a solar system indicia with a first color indicative of a first plane to a solar system indicia with a second color indicative of a second plane or visa versa, the use of the dimensional path cards 28 are needed. Movement between the first and second planes can only be done on the sector cards 12 with a corresponding dimensional path card. The token must progress along the dimensional path card as travelling along a path.

FIRING:

As tokens are fired upon and have been hit, a red peg is placed in a peg hole of the targeted token to indicate a hit has been made. When all the peg holes have been filled, the token is removed from the board.

The battle cruiser token and command ship token are the only token that can fire once without expending one of the actions thereof.

For example:

1) move, fire twice=2 actions 2) fire once at 1 token, fire once at second token=1 action 3) fire, move, fire,=2 actions Before firing, a player must determine the fire power of the firing token. Such a procedure includes rolling the die and adding the number to the predetermined base fire power of "4". The firing player must also indicate which token is firing and which token is being fired upon. If not indicated, the shots are null and void and the action is lost. If the fire power of the firing token exceeds "8" when firing at a heavy cruiser token, battle cruiser token, or command ship token or exceeds "7" when firing at an attack cruiser token, the targeted token is removed from the board.

A repertoire of a fire is an option in which a token may fire twice at one token or fire once at two separate tokens. This is considered as a use of all of the player's actions.

All the tokens may fire short range torpedoes when firing at another token located on the same location marker. Such short range torpedoes have a constant base fire power of "4" for all tokens.

Only heavy cruiser tokens may use long range torpedoes defined as firing at another token from one location marker away. Such long range torpedoes have a constant base fire power of "3".

REPAIRING:

To repair a damaged token, one peg is removed during a player's turn. While a token is being repaired, it cannot perform any other actions. Removing a peg is considered one action, unless executing a repertoire of repair whereby two pegs are removed. This is considered a use of all the player's actions.

Repertoires may be applied at any point in the game and must be announced at the beginning of a player's turn. Prior to a players turn, if being fired upon by two separate enemies on the same plane, a player has the option of an extra action.

The extra action is no longer valid when any of the following conditions are met at the start of the player's turn.

1) one or both enemies declare a cease fire 2) one enemy has been defeated 3) no enemy tokens are within four location markers of the victim's token Once all the players have had a turn, round one is completed. A peg is then placed into the number counter which corresponds with the completed round.

EXCHANGING BUILDING MATERIAL TOKENS FOR FIGHTING TOKENS:

At the end of the fourth round, the players receive a number of building material tokens equivalent to the amount of resource centers in their possession. If there are two allies possessing the same resource center token, no building material token will be awarded unless there is an agreement as to which player will receive it.

If an agreement is not reached by the next 4 rounds, the resource center token must be removed from the board. If the players decide to fight over the resource center, no building material tokens are rewarded until there is a victor.

Each home solar system indicia 15 also receives one building material token. In order to receive building material tokens, a minimum of one fighting token must be positioned on the home solar system indicia. At the end of the fourth round all destroyed tokens are removed from the board and players start round one again.

Construction of any additional attack cruiser tokens, heavy cruiser tokens, battle cruiser tokens or command ship tokens with the use of the building materials can be made anytime during the game and constitutes exchanging building tokens. The newly constructed cruiser or ship token(s) must be placed on the home solar system indicia unless the command ship is located at a resource center belonging to the player. If so, the player may then choose to place the newly constructed cruiser ship tokens(s) at this location or the home solar system indicia. Construction can be done with no penalty immediately after receiving the building materials. If ships are built after round one commences, it will cost the player one action.

At the loss of a home solar system indicia, the captor, which is defined by the player who eliminated the owner thereof, receives any building materials on the home solar system indicia or the sector card wherewhich the home solar system indicia is located. However, the captor may only receive one extra building material after every fourth round in the solar systems bearing a color similar to that of the home solar system. When a player is out of the game, the captor of his home solar system indicia may construct cruiser or ship token(s) in the solar systems bearing a color similar to that of the home solar system of the defeated player. The player must indicate which color of building materials requested at the end of the fourth round. Only one color choice can be made. At the end of the next fourth round, the player may choose again thereby limiting the number of building material acquired at one instance. As is apparent from the above discussion, the object of the game is to force the remaining players out of the game and become the last remaining player.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved battle board game, comprising, in combination:

a plurality of sector cards with sector indicia disposed thereon, the sector cards further having a first plane solar system indicia, a second plane solar system indicia and location markers with a plurality of connecting lines selectively disposed therebetween thereby defining a plurality of paths, the sector cards serving to construct the board game in any shape desired;

a plurality of solar system cards, each of the solar system cards having sector indicia, solar system indicia with a first color defining a first plane indicia and solar system indicia with a second color defining a second plane indicia selectively disposed thereon;

a plurality of dimensional path cards, each of the dimensional path cards having sector indicia and both first plane solar system indicia and second plane indicia corresponding to the sector cards, the dimensional path cards further having a location marker disposed between the first plane solar system indicia and second plane solar system indicia with connecting lines therebetween thereby defining a path, the dimensional path cards serving to allow movement from first plane solar system indicia to second plane solar system indicia;

a playing die;

a plurality of attack cruiser tokens, each of the attack cruiser token having two peg holes therein and adapted to move along the paths;

a plurality of heavy cruiser tokens, each of the heavy cruiser token having three peg holes therein and adapted to move along the paths;

a plurality of battle cruiser tokens, each of the battle cruiser token having four peg holes therein and adapted to move along the paths;

a plurality of command ship tokens, each of the command ship token having four peg holes therein and adapted to move along the paths;

a plurality of resource center cards, each of the resource center cards having sector indicia, first plane solar system indicia, and second plane solar system indicia selectively disposed thereon;

a plurality of resource center tokens positionable on the first plane solar system indicia and second plane solar system indicia of the sector cards;

a plurality of building material tokens, the building material tokens serving to allow exchanging for the battle cruiser tokens, the attack cruiser tokens, the heavy cruiser tokens, and command ship tokens;

a plurality of red pegs, the red pegs corresponding with the peg holes of the battle cruiser tokens, the attack cruiser tokens, the heavy cruiser tokens, and command ship tokens; and a counter with peg, the counter having four peg holes therein, the peg holes serving as a round indicator with the peg occupying one of the four peg holes to indicate the round.

2. A battle board game comprising:

a plurality of sector cards with sector indicia and solar system indicia disposed thereon, the sector cards serving to construct the board game in any shape desired;

a plurality of ship tokens, each of the ship tokens having a plurality of peg holes therein and adapted to move between the solar system indicia;

a plurality of red pegs, the red pegs corresponding with the peg holes of the battle cruiser tokens, the attack cruiser tokens, the heavy cruiser tokens, and command ship tokens;

a playing die to facilitate movement between the solar system indicia; and a plurality of dimensional path cards, each of the dimensional path cards having sector indicia and both first plane solar system indicia and second plane indicia with a path therebetween, the dimensional path cards serving to allow movement from first plane solar system indicia to second plane solar system indicia.

3. A battle board game comprising:

a plurality of sector cards with sector indicia and solar system indicia disposed thereon, the sector cards serving to construct the board game in any shape desired;

a plurality of ship tokens, each of the ship tokens having a plurality of peg holes therein and adapted to move between the solar system indicia;

a plurality of red pegs, the red pegs corresponding with the peg holes of the battle cruiser tokens, the attack cruiser tokens, the heavy cruiser tokens, and command ship tokens;

a playing die to facilitate movement between the solar system indicia;

a plurality of resource center cards, each of the resource center cards having sector indicia and solar system indicia selectively disposed thereon;

a plurality of resource center tokens positionable on the solar system indicia of the sector cards; and a plurality of building material tokens, the building material tokens serving to allow exchanging for the ship tokens.

* * * * *